US010479629B2

(12) United States Patent
Kadota

(10) Patent No.: US 10,479,629 B2
(45) Date of Patent: Nov. 19, 2019

(54) IMAGE READING APPARATUS

(71) Applicant: SEIKO EPSON CORPORATION, Tokyo (JP)

(72) Inventor: Shuichi Kadota, Fukuoka (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/022,613

(22) Filed: Jun. 28, 2018

(65) Prior Publication Data

US 2019/0002225 A1 Jan. 3, 2019

(30) Foreign Application Priority Data

Jun. 29, 2017 (JP) ..... 2017-127042

(51) Int. Cl.

| | |
|---|---|
| ***B65H 7/12*** | (2006.01) |
| ***B65H 3/52*** | (2006.01) |
| ***B65H 3/06*** | (2006.01) |
| ***B65H 7/14*** | (2006.01) |
| ***B65H 7/06*** | (2006.01) |

(52) U.S. Cl.

CPC ..... *B65H 7/125* (2013.01); *B65H 3/063* (2013.01); *B65H 3/0653* (2013.01); *B65H 3/5284* (2013.01); *B65H 7/06* (2013.01); *B65H 7/14* (2013.01); *B65H 2511/522* (2013.01); *B65H 2511/524* (2013.01); *B65H 2553/30* (2013.01); *B65H 2553/80* (2013.01)

(58) Field of Classification Search

CPC . B65H 7/06; B65H 7/125; B65H 7/14; B65H 2553/30; B65H 2553/80

See application file for complete search history.

(56) References Cited

U.S. PATENT DOCUMENTS 6,473,674 B1 * 10/2002 Okada ..... B65H 7/125 700/227
8,391,735 B2 * 3/2013 Kuramochi ..... B65H 7/02 399/389
8,567,777 B2 * 10/2013 Syracuse ..... B65H 7/06 271/258.01

(Continued)

FOREIGN PATENT DOCUMENTS

CN 101568831 10/2009
CN 103946137 7/2014

(Continued)

*Primary Examiner* — Jeremy R Severson
(74) *Attorney, Agent, or Firm* — Workman Nydegger

(57) ABSTRACT

An image reading apparatus includes a feed roller configured to feed paper toward a reading section, and a medium detection section provided along a transport path between the feed roller and the reading section and configured to include a transmitting portion configured to output an output value equivalent to a magnitude of an ultrasonic wave, and determines whether the transport of the paper is to be continued or to be brought to a halt on the basis of a lower limit value and an upper limit value for the output value, which are set in accordance with the kind of the paper. Further, in a case where the output value satisfies a first condition, a transport of the medium is continued, and in a case where the output value satisfies a condition different from the first condition, the transport of the medium is brought to a halt.

7 Claims, 10 Drawing Sheets

(56) References Cited

U.S. PATENT DOCUMENTS

| | | | | |
|---|---|---|---|---|
| 8,727,347 | B2 * | 5/2014 | Ishikawa | B65H 7/125 271/262 |
| 9,981,819 | B2 * | 5/2018 | Arima | B65H 7/125 |
| 10,059,547 | B2 * | 8/2018 | Hayashi | B65H 5/06 |
| 2008/0203654 | A1 | 8/2008 | Chujo et al. | |
| 2009/0223295 | A1 | 9/2009 | Kondo | |
| 2012/0307282 | A1 | 12/2012 | Ishikawa | |
| 2013/0140766 | A1 | 6/2013 | Syracuse et al. | |
| 2014/0054851 | A1 | 2/2014 | Morikawa et al. | |
| 2017/0341890 | A1 * | 11/2017 | Hayashi | B65H 5/06 |

FOREIGN PATENT DOCUMENTS

| | | | | |
|---|---|---|---|---|
| JP | 4812114 | B | | 9/2008 |
| JP | 2011-031999 | A | | 2/2011 |
| JP | 5331568 | B | | 8/2013 |
| JP | 5404870 | B | | 2/2014 |
| JP | 2017088269 | A | * | 5/2017 |

* cited by examiner

IMAGE READING APPARATUS

BACKGROUND

1. Technical Field

The present invention relates to image reading apparatuses for reading an image on each of documents while sequentially transporting the each document.

2. Related Art

Among scanners as an example type of image reading apparatuses, there are scanners mounting therein an ultrasonic wave sensor for the purpose of detecting multi-feeding with respect to a document (medium) that is read in a reading section. Such an ultrasonic wave sensor is configured to include a transmitting portion that is provided on one side of upper and lower sides of a medium being transported on a medium transport path and that is configured to emit an ultrasonic wave, and a receiving portion that is provided on the other side of the upper and lower sides and that is configured to receive the ultrasonic wave having been emitted from the transmitting portion (see, for example, Japanese Patent No. 5,331,568, Japanese Patent No. 5,404,870, and JP-A-2011-031999)

Here, in a medium to be read by the scanner, one or more folds, one or more fold creases, or the like may be formed. Further, when a medium having been brought into a paper jam state during a first reading operation is read once again, bellows-shaped folds having been formed at the time of having been brought into the paper jam state may remain on the medium. For such a medium with one or more folds or wrinkles formed thereon, although having been transported in a normal state on a further upstream side than the reading section, the medium is likely to cause a jam (paper jam) in the reading section where a transport path becomes narrow.

Meanwhile, as a determination method for a jam (paper jam), a method that, in the case where passing of a document is not yet detected although the document has been transported by a predetermined transport amount, determines the occurrence of a jam has been used heretofore. Such a determination method, however, is on the assumption that the jam actually occurs. As a result, at the time of the determination of the jam, actually, damage has already occurred on the document in a large number of cases, and thus, in this respect, there has been a room for improvement.

SUMMARY

An advantage of some aspects of the invention is that an image reading apparatus is provided that minimizes or eliminates the occurrence of a jam in a medium having one or more folds or one or more wrinkle portions by determining whether a single sheet of medium is being transported or a plurality of sheets of media is being transported (multi-feeding) using an ultrasonic wave sensor, and by, in the case where the single sheet of medium is being transported, detecting the presence or absence of the one or more folds or the one or more wrinkle portions in the single sheet of medium.

In a first configuration of an image reading apparatus according to an aspect of the invention, the image reading apparatus includes a reading section configured to read a medium being transported, a feeding means configured to feed the medium toward the reading section, and a medium detection section provided along a medium transport path between the feeding means and the reading section and configured to include a transmitting portion configured to emit an ultrasonic wave and a receiving portion configured to receive the ultrasonic wave emitted from the transmitting portion, and output an output value equivalent to a magnitude of the received ultrasonic wave. Further, in a case where the output value of the receiving portion satisfies a first condition, a transport of the medium is continued, and in a case where the output value of the receiving portion satisfies either a second condition different from the first condition or a third condition different from the second condition, the transport of the medium is brought to a halt.

According to this first configuration, the image reading apparatus evaluates the output value of the receiving portion on the basis of not only the second condition, but also the third condition different from the second condition, and thus, the first configuration enables the medium to be brought to an halt on the basis of not only the presence or absence of multi-feeding, but also the presence or absence of one or more shapes of the medium, such as one or more fold states or one or more wrinkle states (one or more fold creases or one or more bellows-shaped wrinkle portions). With this configuration, the transport of a medium for which the multi-feeding is not occurring, but a jam may occur due to continuous transport is brought to a halt, thereby enabling the prevention of the occurrence of the jam.

In a second configuration of the image reading apparatus according to the aspect of the invention, in the above first configuration, the first condition is satisfied in a case where the output value falls within a reference range prescribed by a lower limit value and an upper limit value; the second condition is satisfied in a case where the output value is lower than the lower limit value; and the third condition is satisfied in a case where the output value is higher than the upper limit value.

In the case of multi-feeding in which a plurality of sheets of media is transported, the output value of the receiving portion is lower than that in the case where a single sheet of medium is transported. Thus, in the case where the output value of the receiving portion is lower than the lower limit value of the reference range, media including the medium are determined to be in a multi-fed state, and the transport of the media is brought to a halt. This configuration, therefore, minimizes or eliminates the transport of the media being in the multi-fed state to the reading section.

Here, the inventors found out that, in the medium detection section, the output value of the receiving portion at the time of passing of a single sheet of medium with a fold or wrinkles formed thereon is higher than the output value of the receiving portion at the time of passing of a single sheet of medium with none of the fold and the wrinkles. Based on this finding, in the case where the output value of the receiving portion is higher than the upper limit value of the reference range, the medium is determined to be a single sheet of medium having one or more fold shapes or one or more wrinkle shapes, and the transport of the medium is brought to a halt. With this configuration, the operation effect of the above-described first configuration is brought about.

In a third configuration of the image reading apparatus according to the aspect of the invention, in the above second configuration, the lower limit value and the upper limit value are set in accordance with the kind of the medium.

According to this third configuration, the lower limit value and the upper limit value are set in accordance with the kind of the medium. Thus, a plurality of kinds of media is applicable.

In a fourth configuration of the image reading apparatus according to the aspect of the invention, in the above first configuration, in a case where the output value of the receiving portion satisfies the second condition, it is notified that the medium being transported is in a multi-fed state, and in a case where the output value of the receiving portion satisfies the third condition, it is notified that the medium being transported is a single sheet of medium including one or more fold shapes or one or more wrinkle shapes.

According to this fourth configuration, in the case where the output value of the receiving portion satisfies the second condition, it is notified that the medium being transported is in a multi-fed state, and in the case where the output value of the receiving portion satisfies the third condition, it is notified that the medium being transported is a single sheet of medium including one or more fold shapes or one or more wrinkle shapes. Thus, the fourth configuration enables a user to be notified of a state of the medium at the time when the transport of the medium has been brought to a halt.

In a fifth configuration of the image reading apparatus according to the aspect of the invention, in the above first configuration, the image reading apparatus further includes a pair of transport rollers provided on a downstream side of the feeding means and an upstream side of the reading section, and the third condition includes a condition in which a difference between the output value of the receiving portion for a first interval and the output value of the receiving portion for a second interval exceeds a predetermined range, the first interval being an interval up to an arrival at a nip point of the pair of transport rollers by a front edge of the medium fed by the feeding means after passing through the medium detection section by the front edge of the medium, the second interval being an interval subsequent to passing through the nip point of the pair of transport rollers by the front edge of the medium.

For a medium with none of the fold, the wrinkles, and the like, in a state after the medium has been fed by the feeding means, the difference between the output values of the receiving portion before and after the nip of the medium by the pair of transport rollers is small. For a medium with one or more folds, one or more wrinkle portions, or the like, however, the posture of the medium is changed between the states before and after the nip by the pair of transport rollers, and thereby, the output value of the receiving portion is likely to be largely changed. According to the fifth configuration, the third condition includes a condition in which the difference between the output values of the receiving portion before and after the nip of the medium by the pair of transport rollers exceeds a predetermined range, and thus, the fifth configuration allows the transport of a medium on which, for example, one or more folds, one or more wrinkle portions, or the like may be formed to be certainly brought to a halt, and thus, as a result, the third condition is further rigorously determined, thereby enabling the possibility that a transport failure and/or a reading failure of the medium may occur to be certainly reduced.

In a sixth configuration of the image reading apparatus according to the aspect of the invention, in the above first configuration, the third condition includes a condition in which a difference between the output value of the receiving portion for a antecedent medium and the output value of the receiving portion for a subsequent medium exceeds a predetermined range.

When the feeding means successively feeds an antecedent medium that is antecedently read by the reading section and a subsequent medium that is read subsequently to the antecedent medium, in the case where the difference between the output value of the receiving portion for the antecedent medium and the output value of the receiving portion for the subsequent medium largely differ, there is a possibility that the subsequent medium is in a state different from a state of the antecedent medium. According to the sixth configuration, the third condition includes a condition in which the difference between the output value of the receiving portion for the antecedent medium and the output value of the receiving portion for the subsequent medium exceeds a predetermined range, and thus, as a result, the third condition is further rigorously determined, thereby enabling the possibility that a transport failure and/or a reading failure of the subsequent medium may occur to be certainly reduced.

In a seventh configuration of the image reading apparatus according to the aspect of the invention, in the above first configuration, the receiving portion is disposed in a concave portion provided on a side of one transport path face among a pair of transport path faces between which the medium being transported is interposed, and the concave portion includes a medium scooping portion provided in such a way as to protrude from an opening of the concave portion toward an inside, and partially cover a downstream side portion of the receiving portion.

According to this seventh configuration, the medium scooping portion is included in the opening of the concave portion, and thus, the possibility that the medium being transported may be caught by the concave portion is minimized. In this case, although the medium scooping portion is provided in such a way as to partially cover a downstream side portion of the receiving portion, the downstream side portion of the receiving portion is a region where the sensitivity as the receiving portion is decreased, thus enabling the scooping portion to be formed in such a way that the influence on the receiving status of the receiving portion is reduced.

In an eighth configuration of the image reading apparatus according to the aspect of the invention, in the above first configuration, the receiving portion is disposed in a concave portion provided on a side of one transport path face among a pair of transport path faces between which the medium being transported is interposed, and the concave portion includes a shutter portion configured to slide from a downstream side toward an upstream side to adjust an open state of an opening of the concave portion.

This eighth configuration enables the adjustment of the open state of the opening of the concave portion, in which the receiving portion is provided.

In a ninth configuration of the image reading apparatus according to the aspect of the invention, in the above eighth configuration, when the medium is thin paper, the opening is brought into an open state in which a portion of the shutter portion partially covers a downstream side portion of the receiving portion.

In the case where the medium is thin paper, when the thin paper is transported, the thin paper is likely to be caught by the opening of the concave portion. According to this ninth configuration, in the case where the medium is thin paper, the size of the opening becomes small enough to minimize the possibility that the thin paper may be caught by the opening. In this case, although the shutter portion is provided in such a way as to partially cover a downstream side portion of the receiving portion, the downstream side portion of the receiving portion is a region where the sensitivity as the receiving portion is decreased, thus enabling the influence on the receiving status of the receiving portion to be reduced.

In a tenth configuration of the image reading apparatus according to the aspect of the invention, in the above eighth configuration or the above ninth configuration, in the case where a medium detection using the medium detection section is not made, the opening is brought into a closed state in which the shutter portion entirely coves the opening.

This tenth configuration minimizes the possibility that the medium being transported may be caught by the opening of the concave portion, in which the receiving portion is provided.

BRIEF DESCRIPTION OF THE DRAWINGS

The invention will be described with reference to the accompanying drawings, wherein like numbers reference like elements.

DESCRIPTION OF EXEMPLARY EMBODIMENTS

Practice Example 1

First, the outline of an image reading apparatus according to a practice example 1 of the invention will be described. In the present practice example, as one example of the image reading apparatus, a document scanner (hereinafter referred to as just a scanner 1) capable of reading at least one of the obverse side and the reverse side of a medium will be exemplified.

Figure 1:
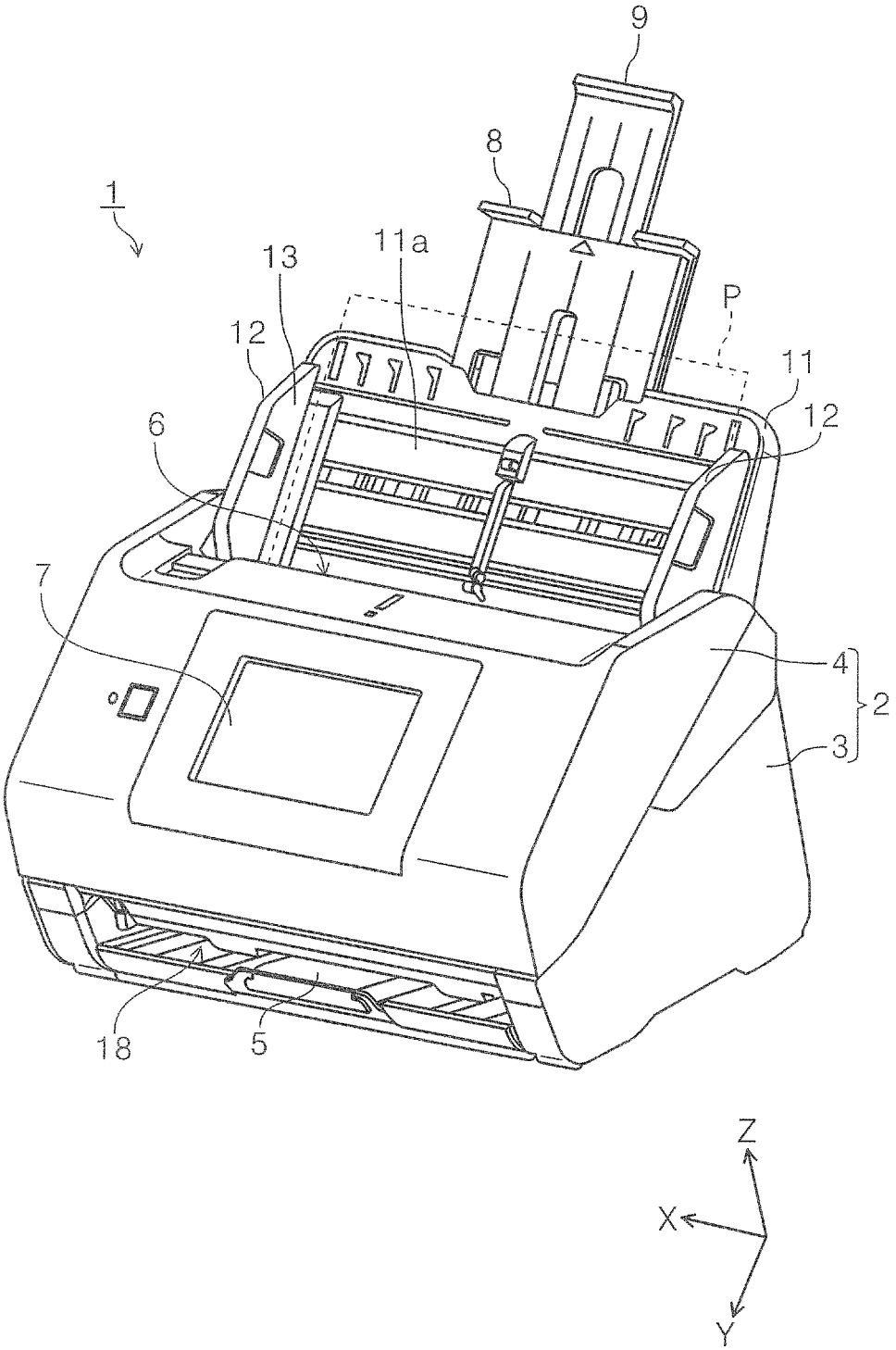
FIG. 1 is a perspective, exterior view of a scanner according to practical examples of the invention.
Figure 2:
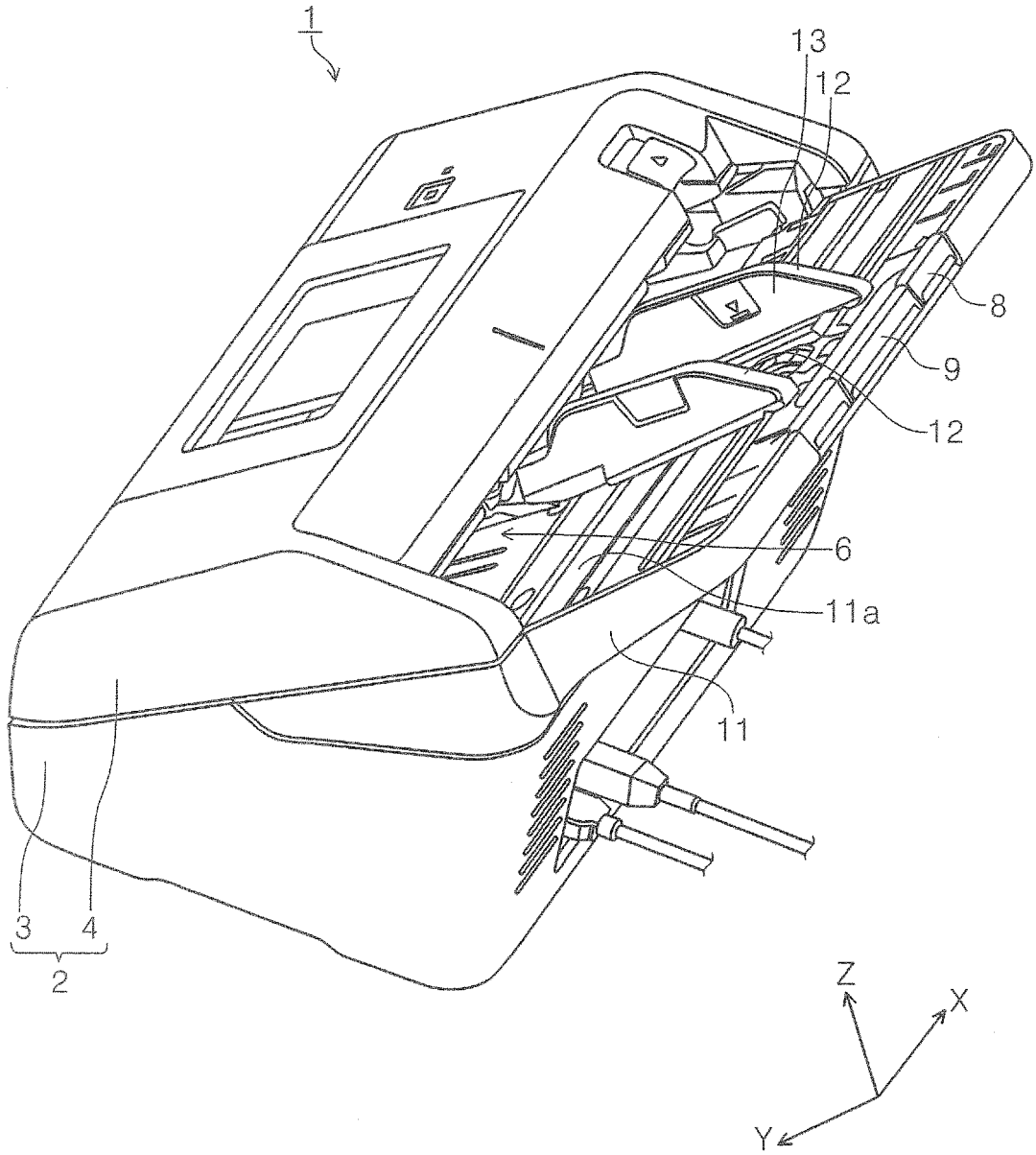
FIG. 2 is a perspective view of the scanner according to the practical examples, from an angle different from that of FIG. 1.
Figure 3:
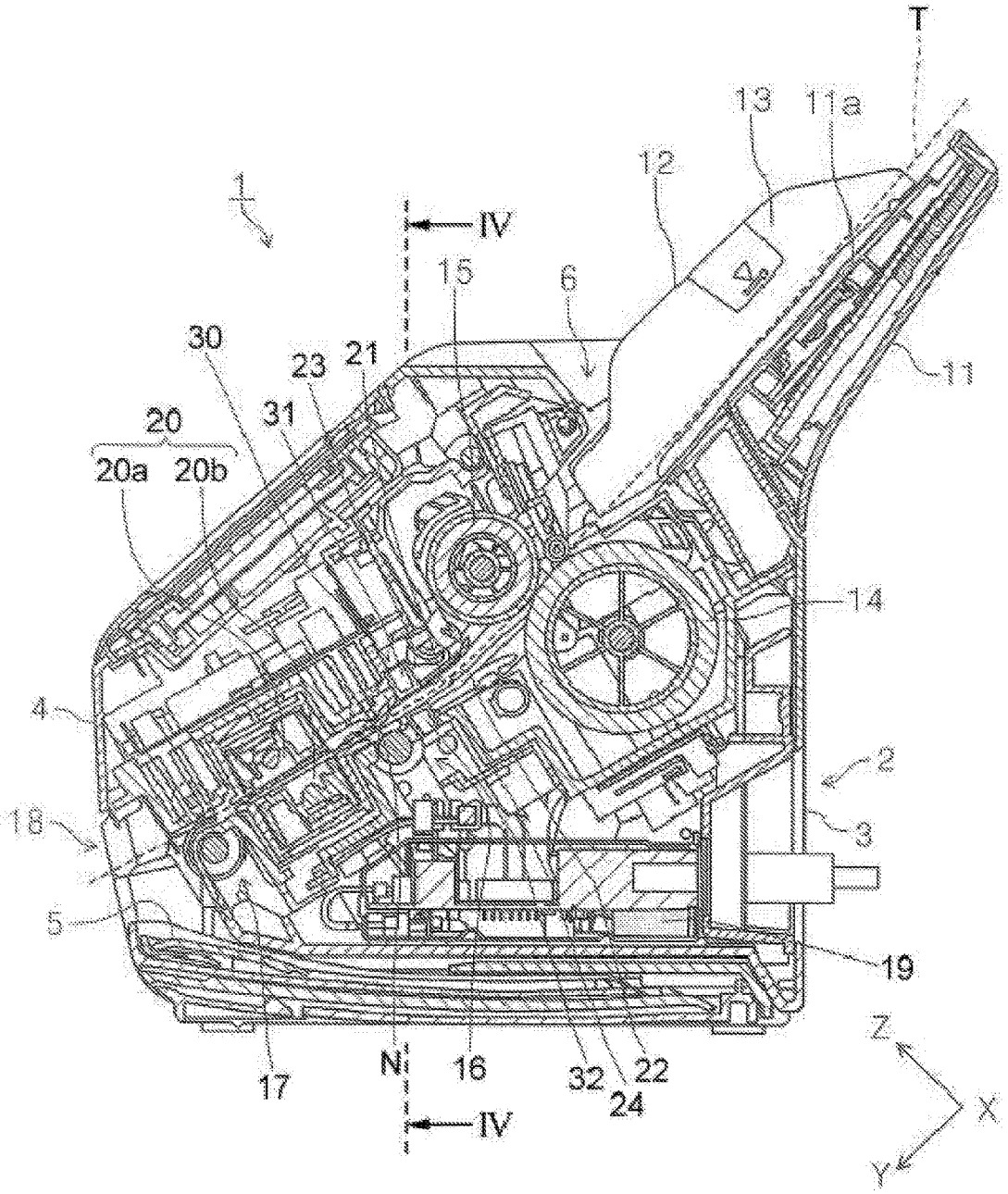
FIG. 3 is a side cross-sectional view of the scanner according to the practical examples, illustrating a paper transport path in the scanner.
Figure 4:
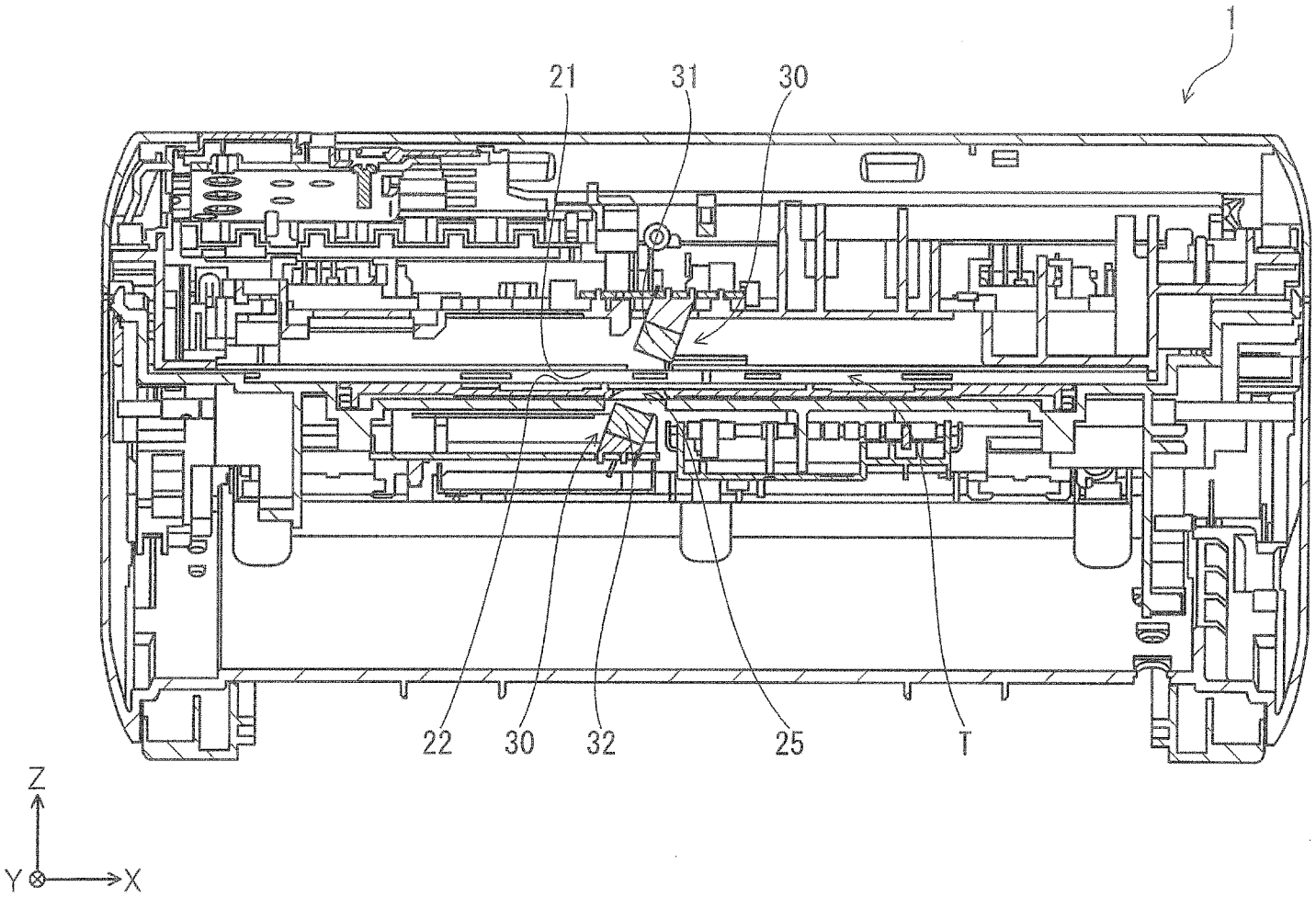
FIG. 4 is a cross-sectional view of the scanner, taken along the line IV-IV of FIG. 3.
Figure 5:
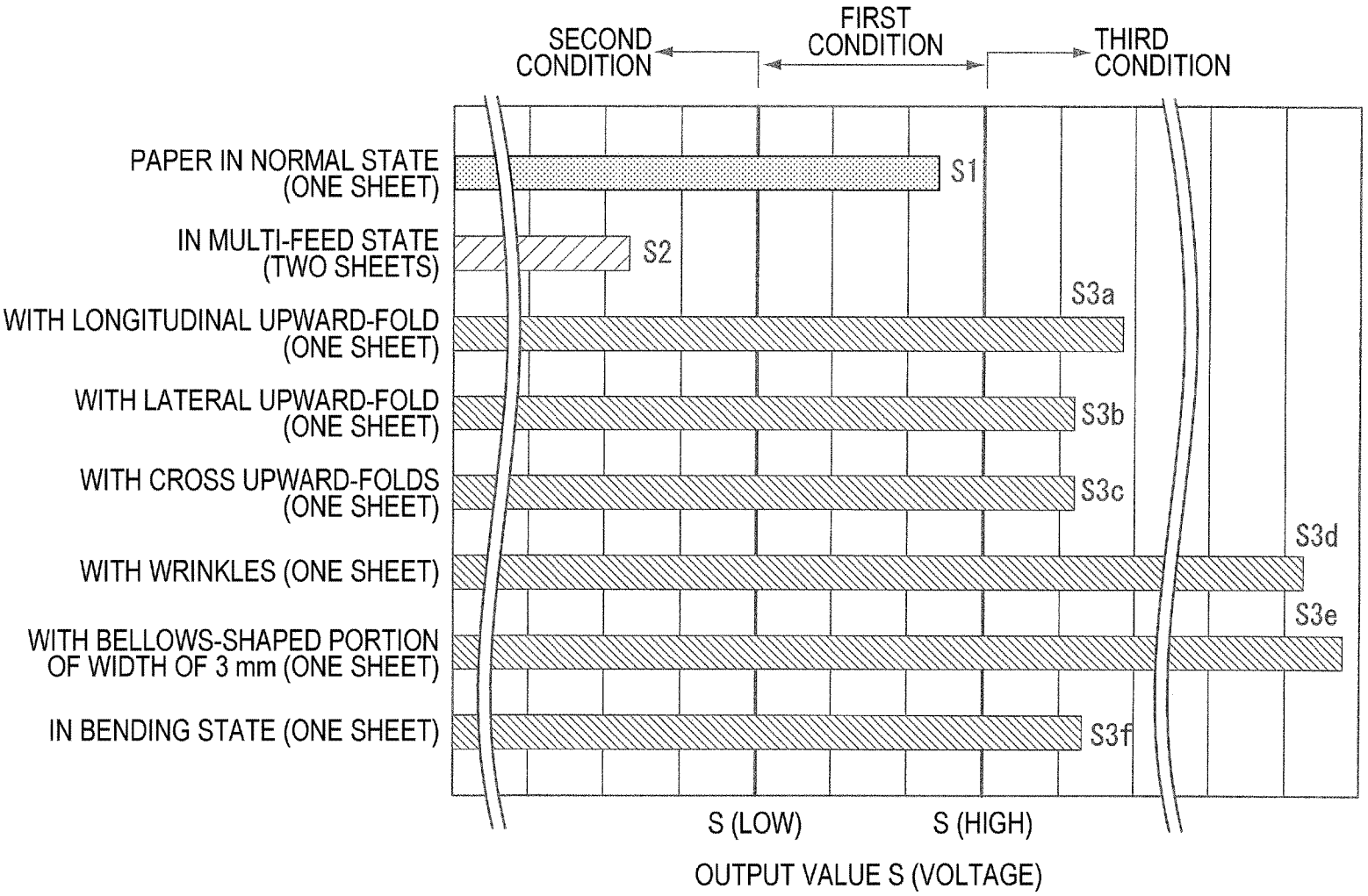
FIG. 5 is a diagram illustrating relations between output values from a receiving portion of the scanner and first, second, and third conditions.
Figure 6:
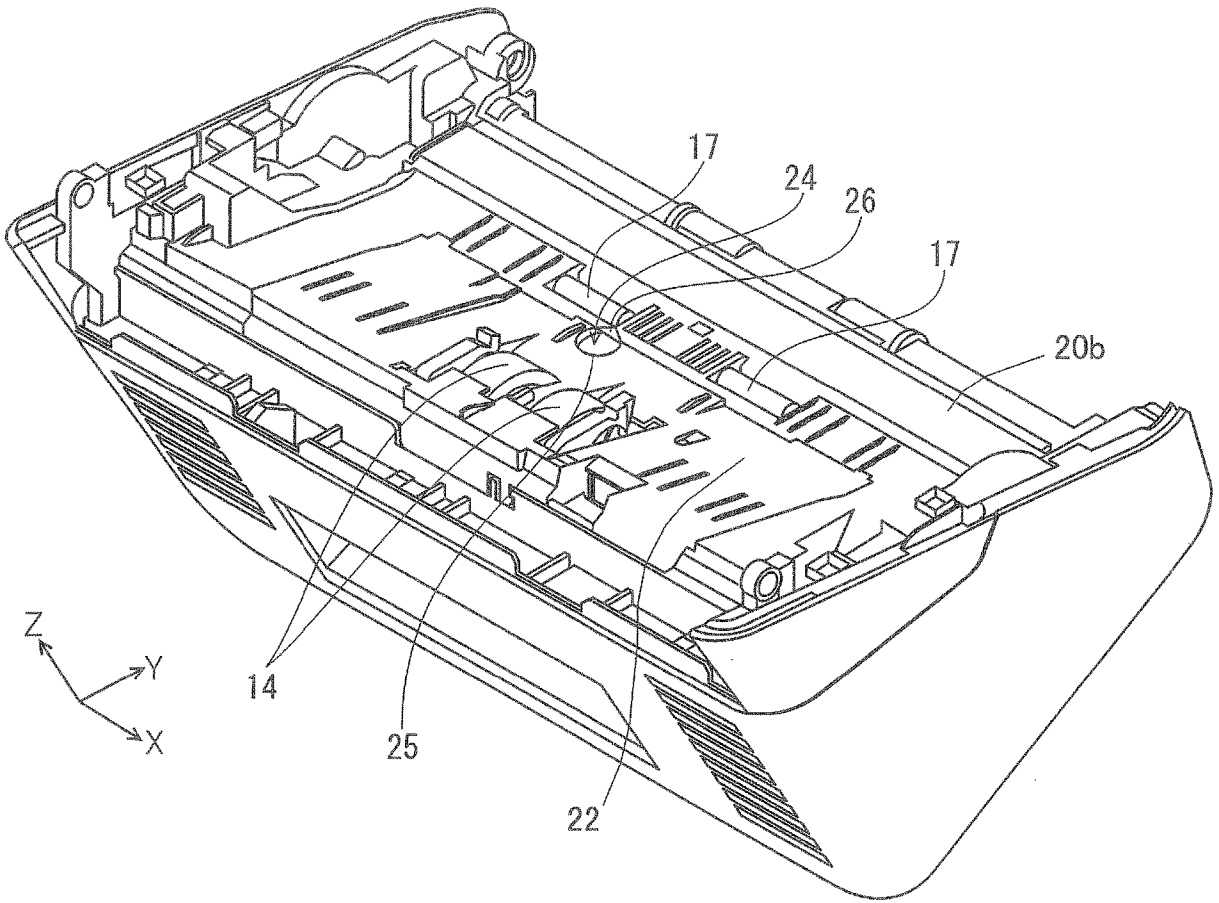
FIG. 6 is a perspective view of the scanner, illustrating a state in which its upper unit is removed and its lower path face is exposed.
Figure 7:
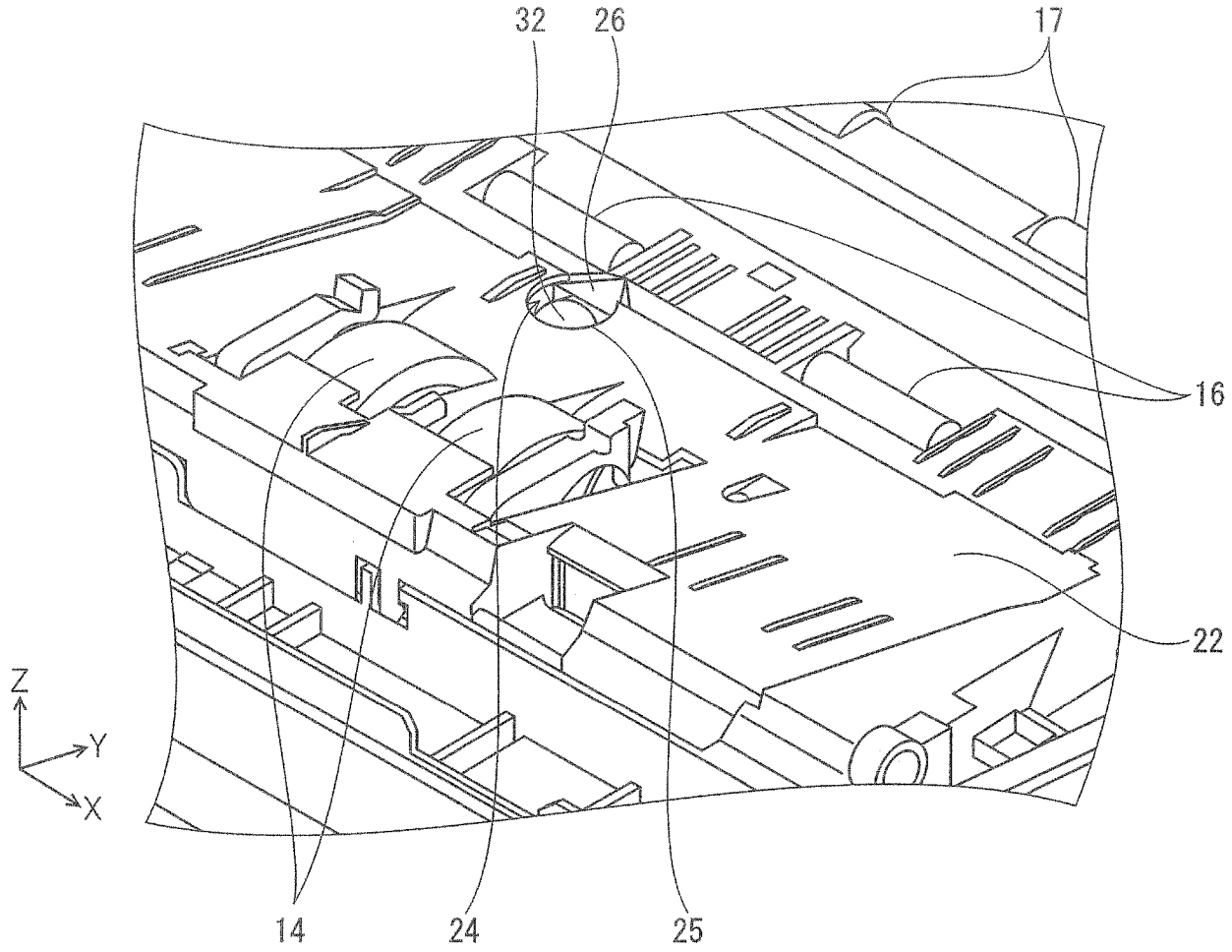
FIG. 7 is a main portion enlarged view of FIG. 6, and a perspective view of the main portion, that is, the vicinity of a receiving portion of the scanner.
Figure 8:
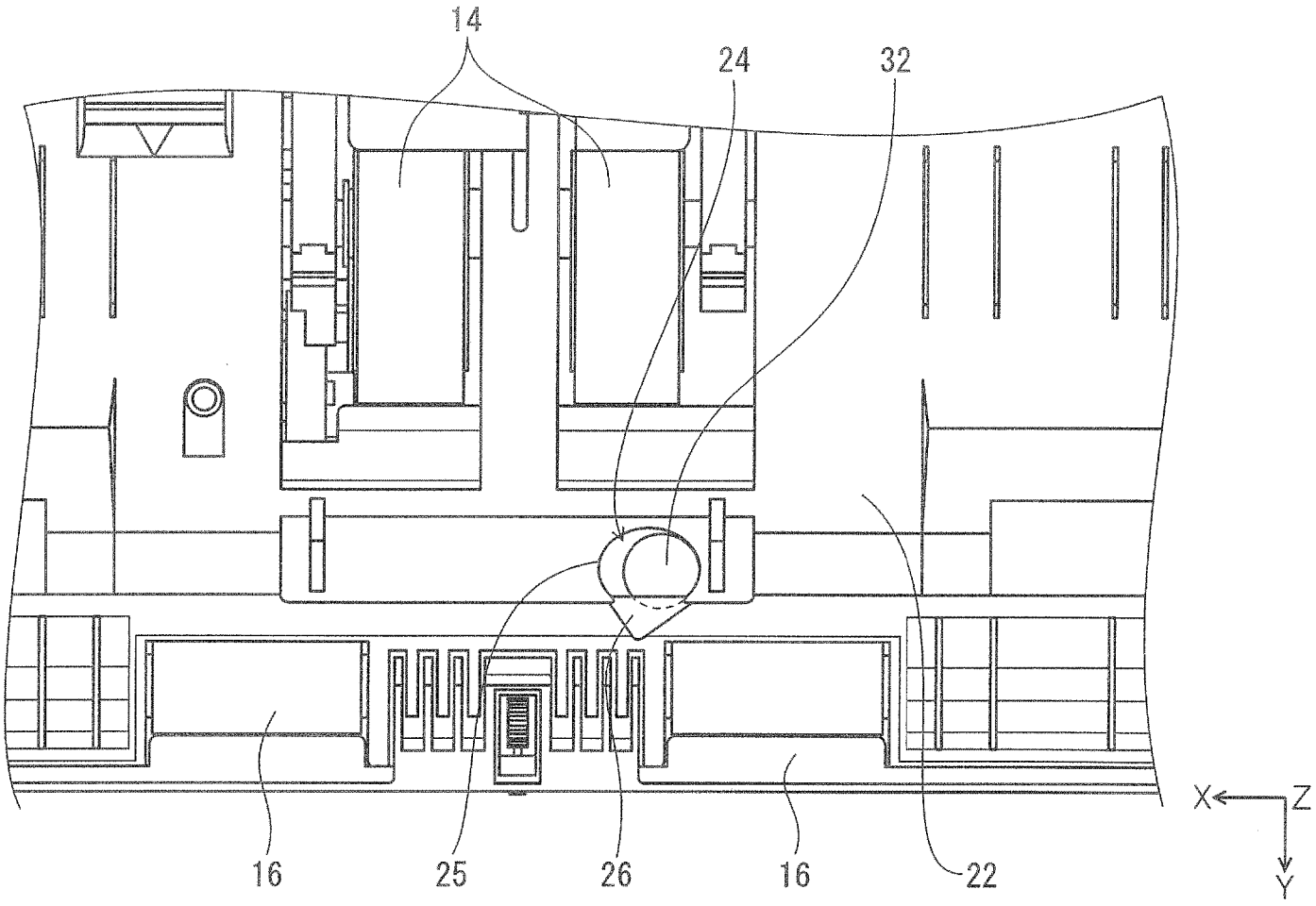
FIG. 8 is a plan view of the vicinity of the receiving portion.
Figure 9:
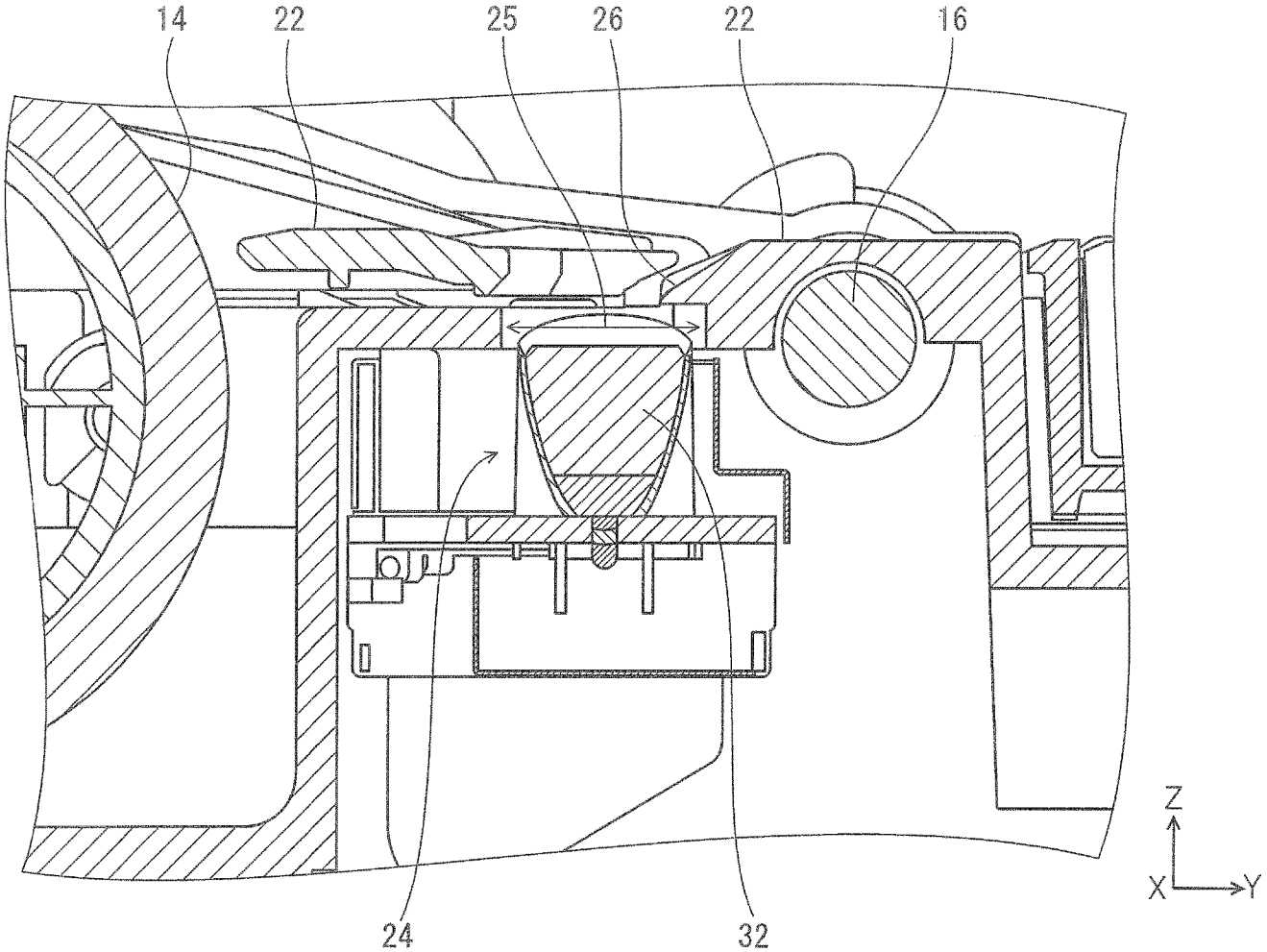
FIG. 9 is a cross-sectional view of the vicinity of the receiving portion, taken along a Y-Z plane.

FIG. 1 is a perspective, exterior view of the scanner 1 according to the present practice example of the invention. FIG. 2 is a perspective view of the scanner 1 according to the present practice example of the invention, from an angle different from that of FIG. 1. FIG. 3 is a side cross-sectional view of the scanner 1 according to the present practice example of the invention, illustrating a paper transport path in the scanner 1. FIG. 4 is a cross-sectional view of the scanner 1, taken along the line IV-IV of FIG. 3. FIG. 5 is a diagram illustrating relations between output values from a receiving portion of the scanner 1 and first, second, and third conditions. FIG. 6 is a perspective view of the scanner 1, illustrating a state in which its upper unit is removed and its lower path face is exposed. FIG. 7 is a main portion enlarged view of FIG. 6, and a perspective view of the main portion, that is, the vicinity of a receiving portion of the scanner 1. FIG. 8 is a plan view of the vicinity of the receiving portion. FIG. 9 is a cross-sectional view of the vicinity of the receiving portion, taken along a Y-Z plane.

In an X-Y-Z coordinate system illustrated in each of figures, an X-axis direction corresponds to an apparatus width direction, that is, a paper width direction, and a Y-axis direction corresponds to a paper transport direction. A Z-axis direction is a direction intersecting with the Y-direction, and indicates a direction approximately orthogonal to the face of paper being transported. Further, a +Y-direction side is defined as an apparatus front side, and a −Y-direction side is defined as an apparatus rear side. Further, a left side and a right side viewed from the apparatus front side are respectively defined as a +X-direction side and an −X-direction side. Further, a +Z-direction side is defined as apparatus upper side (including an upper portion, an upper face, and the like), and a −Z-direction side is defined as an apparatus lower side (including a lower portion, a lower face, and the like). Further, a direction in which paper P is fed (namely, the +Y-direction side) is referred to as a "downstream side", and a direction opposite the above direction (namely, the −Y-direction side) is referred to as an "upstream side".

Outline of Scanner

Hereinafter, the scanner 1 according to practice examples of the invention will be described mainly referring to FIGS. 1 and 2.

The scanner 1 includes an apparatus body 2, and this apparatus body 2 includes, in its inside, a reading section 20 (FIG. 3). This reading section 20 is configured to read an image on paper P. The apparatus body 2 is configured to include a lower unit 3 and an upper unit 4. The upper unit 4 is secured to the lower unit 3 in such a way as to be openable/closable relative to the lower unit 3 about its paper transport-direction downstream side serving as a pivot support point. Thus, the upper unit 4 is configured to be allowed to pivot and open toward an apparatus front side, and this configuration allows a paper transport path of the paper P to be exposed to thereby facilitate a jam treatment for the paper P.

A medium mount portion 11 is provided on the apparatus rear side (on the −Y-axis direction side) of the apparatus body 2. The medium mount portion 11 includes a mount face 11*a*, and on this mount face 11*a*, the paper P to be fed is mounted. The medium mount portion 11 is provided in such a way as to be attachable/detachable relative to the apparatus body 2. Further, the medium mount portion 11 includes a pair of left and right side edge guides 12. The pair of edge guides 12 includes guide faces 13, and the guide faces 13 guide width-direction side edges of the paper P. Here, the width direction means a width direction of the paper P (namely, the X-axis direction), the width direction intersecting with a feed direction of the paper P (namely, the Y-axis direction).

The medium mount portion 11 includes a first auxiliary paper support 8 and a second auxiliary paper support 9. As illustrated in FIG. 2, the medium mount portion 11 is capable of containing, in its inside, the first auxiliary paper support 8 and the second auxiliary paper support 9. Further, as illustrated in FIG. 1, the first auxiliary paper support 8 and the second auxiliary paper support 9 are configured to be drawable from the medium mount portion 11, and this configuration enables the adjustment of the length of the mount face 11*a*.

The apparatus body 2 includes an operation panel 7 on the apparatus front side of the upper unit 4. This operation panel 7 is a panel through which operations for various reading settings and a reading execution are performed and on which the contents of the reading settings, and the like, are displayed. A feeding inlet 6 is provided in an upper portion of the upper unit 4, and this feeding inlet 6 communicates with the inside of the apparatus body 2. The paper P mounted on the medium mount portion 11 is fed from the feeding inlet 6 toward the reading section 20, which is provided in the inside of the apparatus body 2. Further, a paper discharge tray 5 is provided on the apparatus front side of the lower unit 3. The paper discharge tray 5 will be described later.

Regarding Paper Transport Path in Scanner

Next, a paper transport path in the scanner 1 will be described with reference to FIG. 3. Here, a dashed line denoted by a reference sign T in FIG. 3 indicates the paper transport path.

A feed roller 14 and a separation roller 15 are provided on the downstream side of the medium mount portion 11. This feed roller 14 serves as "a feeding means", and feeds the paper P having been mounted on the mount face 11*a* of the medium mount portion 11 toward the reading section 20. The separation roller 15 separates the paper P by nipping the paper p with the feed roller 14.

The paper p having been mounted on the mount face 11*a* of the medium mount portion 11 is picked up and fed toward the downstream side (namely, the +Y-direction side) by the feed roller 14 that is provided in such a way as to be rotatable relative to the lower unit 3.

Specifically, the feed roller 14 is allowed to rotate while being in contact with a face of the paper p, the face facing the mount face 11*a*, and thereby feeds the paper P toward the downstream side. Thus, in the scanner 1, in the case where a plurality of sheets of paper P has been set on the medium mount portion 11, each of the sheets of paper P is transported toward the downstream side sequentially from a single sheet of paper P having been located nearest the mount face 11*a*.

A pair of transport rollers 16, the reading section 20, which reads an image, and a pair of discharge rollers 17 are provided on the downstream side of the feed roller 14. The paper P having been nipped and fed toward the downstream side by the transport roller 14 and the separation roller 15 is nipped by the pair of transport rollers 16, and is transported to the reading section 20 that is located on the downstream side of the pair of transport rollers 16.

A medium detection section 30 is provided along a transport path between the feed roller 14 and the reading section 20. The medium detection section 30 is configured to include a transmitting portion 31 and a receiving portion 32. The transmitting portion 31 emits an ultrasonic wave, and the receiving portion 32 receives the ultrasonic wave emitted from the transmitting portion 31, and outputs an output value equivalent to a magnitude of the received ultrasonic wave. The transmitting portion 31 and the receiving portion 32 are provided in such a way as to interpose the transport path therebetween. More specifically, the transmitting portion 31 is provided on the upper unit 4 side, and the receiving portion 32 is provided on the lower unit 3 side. In the present practice example, the medium detection section 30 is capable of detecting the multi-feeding of the paper P being transported and the paper P having one or more folds, one or more wrinkle portions, or the like. The medium detection section 30 will be described later in detail.

The reading section 20 includes an upper reading sensor 20*a* and a lower reading sensor 20*b*. The upper reading sensor 20*a* is provided on the upper unit 4 side, and the lower reading sensor 20*b* is provided on the lower unit 3 side. In the present practice example, each of the upper reading sensor 20*a* and the lower reading sensor 20*b* is configured as a contact-type image sensor module (CISM).

After the paper P has been subjected to reading of an image on at least one of its obverse side and its reverse side in the reading section 20, the paper P is nipped by the pair of discharge rollers 17 that is located on the downstream side of the reading section 20, and is discharged from a discharge outlet 18. The discharge outlet 18 is provided on the apparatus front side of the lower unit 3.

Note that, in the present practice example, the feed roller 14, the pair of transport rollers 16, and the pair of discharge rollers 17 are rotation-driven by at least one driving source (not illustrated) provided inside the lower unit 3. Further, the at least one driving source (not illustrated) is controlled by a control section 19, and thus, the driving of each of the feed roller 14, the pair of transport rollers 16, and the pair of discharge rollers 17 is controlled by the control section 19.

In the lower unit 3, the discharge tray 5 is provided, and the discharge tray 5 is configured to be drawable toward the apparatus front side from the discharge outlet 18. The discharge tray 5 is capable of taking a state in which the discharge tray 5 is contained in a bottom portion of the lower unit 3 (FIG. 1) and a state in which the discharge tray 5 is drawn to the apparatus front side (this state being omitted from illustration). In the state in which the discharge tray 5 is drawn, the paper P having been discharged from the discharge outlet 18 can be stacked on the discharge tray 5.

Regarding Medium Detection Section

As described above, the medium detection section 30 (FIGS. 3 and 4) is configured to include the transmitting portion 31 and the receiving portion 32, and as described in FIG. 3, the transmitting portion 31 and the receiving portion 32 are respectively provided on the upper side and the lower side in such a way as to interpose a paper transport path T therebetween.

The receiving portion 32 is located in a lower concave portion 24 (FIG. 3), and this lower concave portion 24 is provided on the side of a lower path face 22. This lower path face 22 is one of a pair of transport path faces (namely, an upper path face 21 and the lower path face 22) interposing the paper P being transported. The transmitting portion 31 is located in an upper concave portion 23 (FIG. 3), and this upper concave portion 23 is provided on the side of an upper path face 21. This upper path face 21 is the other one of the pair of transport path faces (namely, the upper path face 21 and the lower path face 22) interposing the paper P being transported.

Further, as illustrated in FIG. 3, the transmitting portion 31 and the receiving portion 32 are disposed and face each other at positions that are the same in the Y-axis direction. Further, as illustrated in FIG. 4, the transmitting portion 31 and the receiving portion 32 are disposed at positions that are out of alignment in the X-axis direction, and the face of the transmitting portion 31 and the face of the receiving portion 32, these faces facing each other, are disposed in such a way as to be inclined relative to the X-axis direction.

The transmitting portion 31 emits an ultrasonic wave toward the receiving portion 32 side. The receiving portion 32 receives the ultrasonic wave emitted from the transmitting portion 31, and outputs an output value S. This output value S is equivalent to a magnitude of the received ultrasonic wave. The receiving portion 32 according to the present practice example converse the received ultrasonic wave into a voltage signal, and outputs the voltage signal. That is, in the present practice example, the output value S is a voltage. The output value S is transmitted to the control section 19, and the control section 19 is configured to make a determination in accordance with the output value S and control the transport of the paper P.

Specifically, in the case where the output value S of the receiving portion 32 satisfies "a first condition", the control section 19 continues the transport of the paper P, and in the case where the output value S of the receiving portion 32 satisfies either "a second condition" different from "the first condition" or "a third condition" different from the second condition, the control section 19 brings the transport of the paper P to a halt.

In the case where the paper P (one sheet) is transported in a normal state, the emitted ultrasonic wave is intercepted by the paper P passing between the transmitting portion 31 and the receiving portion 32, and thus, an ultrasonic wave received by the receiving portion 32 is attenuated to a greater degree than an ultrasonic wave that is received by the receiving portion 32 in a state in which the paper P is not transported. Thus, an output value S1, as an output value in a state in which the paper P (one sheet) is transported, is decreased than an output value S0, as an output value in a state in which the paper P is not transported. This configuration, therefore, enables making a determination that, when the output value S from the receiving portion 32 falls within a predetermined reference range, the paper P is one sheet of paper P being transported in a normal state.

In the practice example, "the first condition" is satisfied in the case where the output value S falls within the above predetermined reference range, that is, a reference range prescribed by a lower value S (Low) and an upper value S (High) (FIG. 5). "The first condition" is a condition based on which a determination that the paper P being transported is a single sheet is made. That is, in the case where the output value S of the receiving portion 32 satisfies "the first condition", which is a condition based on which a determination that the paper P being transported is a single sheet of paper P being transported in a normal state is made, the control section 19 continues the transport of the paper P.

In contrast, in the case where the output value S of the receiving portion 32 does not satisfy "the first condition", the paper P being transported may not be the single sheet of paper P being transported in a normal state. For example, in the case where multi-feeding (a state in which two sheets of paper P are transported in a state of overlapping each other) is occurring, the ultrasonic wave received by the receiving portion 32 is attenuated to a further degree than the case where the paper P is a single sheet. Thus, the output value S2 at the time when the multi-feeding is occurring is attenuated to a further degree than the output value S1, which is the output value at the time when the paper P (a single sheet) is being transported.

This configuration, therefore, enables making a determination that, when the output value S from the receiving portion 32 is lower than the lower limit value S (Low) of the reference range, as "the first condition, which is prescribed by the lower limit value S (Low) and the upper limit value S (High), the multi-feeding is occurring. Further, "the second condition" is defined as a condition that is satisfied in the case where the output value S is lower than the lower limit value S (Low) (FIG. 5), and in the case where "the second condition" is satisfied, the control section 19 brings the transport of the paper P to a halt. This configuration, therefore, minimizes or eliminates the transport of the paper P to the reading section 20 in a multi-fed state.

Here, the inventors found out that, in the medium detection section 30, the output value S of the receiving portion 32 at the time of passing of the paper P with a fold or wrinkles formed thereon satisfies "the third condition", which is different from the condition for the multi-feeding. Specifically, an output value S3 (any one of output values S3a to S3f in FIG. 5), as an output value of the receiving portion 32 at the time of passing of the paper P with a fold or wrinkles formed thereon, becomes higher than the output value S1 of the receiving portion 32, at the time of passing of a single sheet of paper P being transported in a normal state and having none of the fold and the wrinkles.

Based on this finding, in the practice example, "the third condition" is defined as a condition that is satisfied in the case where the output value S is higher than the upper limit value S (High) (FIG. 5), and when the output value S satisfies "the third condition", the control section 19 brings the transport of the paper P to a halt.

Here, the output values S3a to S3f, which are illustrated in FIG. 5, are examples of the output value S3 of the receiving portion 32 at the time of passing of a single sheet of paper P with a fold or wrinkles formed thereon. An output value for a single sheet of paper with an upward fold formed thereon along the medium transport direction ("WITH LONGITUDINAL UPWARD FOLD" in FIG. 5") corresponds to the output value S3a. An output value for a single sheet of paper with an upward fold formed thereon along the width direction intersecting with the medium transport direction ("WITH LATERAL UPWARD FOLD" in FIG. 5") corresponds to the output value S3b. An output value for a single sheet of paper with folds formed thereon along the medium transport direction and the width direction, that is, a single sheet of paper with cross folds formed thereon ("WITH CROSS FOLDS" in FIG. 5) corresponds to the output value S3c. An output value for a single sheet of paper with wrinkles randomly formed thereon ("WITH WRINKLES" in FIG. 5) corresponds to the output value S3d. An output value for a single sheet of paper having a bellows-shaped portion of a width of 3 mm ("WITH BELLOWS-SHAPED PORTION OF WIDTH OF 3 mm" in FIG. 5) and being on the assumption of a state of the single sheet of paper, in which a jam (paper jam) has occurred within the paper transport path T, corresponds to the output value S3e. An output value for a single sheet of paper being in a state of bending in the medium transport direction ("IN BENDING STATE" in FIG. 5) corresponds to the output value S3f.

As described above, for a single sheet of paper having a fold, wrinkles, or bending, the output value S becomes higher than the upper limit value S (High). The reason why, for such a single sheet of paper having a fold, wrinkles, or bending, the output value S becomes higher than the output value S1 for paper being transported in a normal state is not clear, but it is assumed that the ultrasonic wave is likely to easily pass through from the vicinity of the summit of each of the fold and the wrinkles, and as a result, the magnitude of the ultrasonic wave received by the receiving portion 32 is increased, thereby causing the output value to be also increased.

As described above, in the scanner 1, the evaluation of the output value S of the receiving portion 32 based on not only "the second condition", but also "the third condition", which is different from "the second condition", not only enables the transport of the paper P to be brought to a halt on the basis of the presence or absence of the multi-feeding, but also enables the transport of the paper P to be brought to a halt on the basis of the presence or absence of one or more shapes of the paper P, such as one or more fold states or one or more wrinkle states (one or more fold creases or one or more bellows-shaped wrinkle portions). With this configuration, the transport of a medium for which the multi-feeding is not occurring, but a jam may occur due to continuous transport is brought to a halt, thereby enabling the prevention of the occurrence of the jam. Further, when a user performs a treatment of smoothing the fold or the wrinkles on the paper P for which the occurrence of the jam has been prevented, that is, which has the fold or the wrinkles thereon, and then, sets the relevant paper P onto the scanner 1 once again, the user is able to obtain a favorable reading result.

Note that the lower limit value S (Low) and the upper limit value S (High) are set in accordance with the kind of the paper P. As the kinds of the paper P, various kinds of paper among which there are differences in rigidity and/or basis weight (weight per unit area of paper), such as regular paper, thin paper, and thick paper, can be exemplified. Setting the lower limit value S (Low) and the upper limit value S (High) in accordance with each of the kinds of paper enables the use of a plurality of kinds of paper.

Further, preferably, the scanner 1 is configured to, in the case where the output value S of the receiving portion 32 satisfies "the second condition," notify that the paper P being transported is in a multi-fed state, and to, in the case where the output value S of the receiving portion 32 satisfies "the third condition," notify that the paper P being transported is a single sheet of paper having one or more fold shapes or one or more wrinkle shapes. This configuration enables a user to be notified of the state of the paper P for which "the second condition" or "the third condition" has been satisfied and the transport has been brought to a halt. Examples of methods for notifying the state of the paper P include, but are not limited to, displaying on a display portion of the operation panel 7, lighting or blinking of a light, such as an LED, provided on the scanner 1, and notifying by means of a scanner driver.

Regarding Third Condition

Further, when an output value S4 indicates an output value of the receiving portion 32 during an interval up to an arrival at a nip point N (FIG. 3), as a nip point of the pair of transport rollers 16, by the front edge of the paper P fed by the feed roller 14 after passing through the medium detection section 30 by the front edge of the paper P; and an output value S5 indicates an output value of the receiving portion 32 subsequent to passing through the nip point N of the pair of transport rollers 16 by the front edge of the paper P, a condition in which the difference between the output values S4 and S5, that is, a difference (S4−S5), exceeds a predetermined range may be included in "the third condition" as a condition satisfying "the third condition".

In the above case, the output value S4 is an output value before the arrival at the nip point N of the pair of transport rollers 16 by the front edge of the paper P fed by the feed roller 14, that is, an output value in a state in which the front edge of the paper P is nipped by only a pair of the feed roller 14 and the separation roller 15; while the output value S5 is an output value after the passing through the nip point N of the pair of rollers 16, that is, an output value in a state in which the front edge of the paper P is nipped by both of the pair of the feed roller 14 and the separation roller 15 and the pair of transport rollers 16. In this case, for the paper P having none of the folds and the wrinkle portions, the posture of the paper P is stable, and thus, the difference (S4−S5) is small; whereas in contrast, for the paper P having one or more folds, one or more wrinkle portions, or the like, the posture of the paper P is likely to change between the states before and after the nip by the pair of transport rollers 16, and thus, a situation where the output value of the receiving portion 32 largely changes may arise.

In view of such a situation, the condition in which the difference (S4−S5), which is the difference between the output values of the receiving portion 32 before and after the nip of the front edge of the paper P by the pair of transport rollers 16, exceeds a predetermined range, is included in "the third condition" as a condition satisfying "the third condition", and thereby, as a result, "the third condition" is more rigorously determined. This configuration, therefore, allows the transport of the paper P on which, for example, one or more folds, one or more wrinkle portions, or the like may be formed thereon to be further certainly brought to a halt, thereby enabling the possibility that a transport failure and/or a reading failure of the paper P may occur to be further certainly reduced.

In addition, the above predetermined range for the difference (S4−S5), based on which it is determined whether or not "the third condition" is satisfied, can be set to approximately 10% of the output value S4, which is the output value S before the arrival at the nip point N of the pair of transport rollers 16 by the front edge of the paper P fed by the feed roller 14.

Moreover, when an output value S6 indicates an output value of the receiving portion 32 for a antecedent medium, and an output value S7 indicates an output value of the receiving portion 32 for a subsequent medium, a condition in which the difference between the output values S6 and S7, that is, a difference (S6−S7), exceeds a predetermined range may be included in "the third condition" as a condition satisfying "the third condition".

When the feed roller 14 successively feeds the antecedent medium and the subsequent medium, in the case where the difference between the output value S of the receiving portion 32 for the antecedent medium and the output value S of the receiving portion 32 for the subsequent medium largely differs, there is a possibility that the state of the subsequent medium may be different from the state of the antecedent medium.

In this case, "the third condition" includes the condition in which the difference (S6−S7), which is the difference between the output value S6 of the receiving portion 32 for the antecedent medium and the output value S7 of the receiving portion 32 for the subsequent medium, exceeds a predetermined range, and thereby, as a result, "the third condition" is further rigorously determined, thereby enabling the possibility that a transport failure and/or a reading failure of the subsequent medium may occur to be further certainly reduced.

In addition, the above predetermined range for the difference (S6−S7), based on which it is determined whether or not "the third condition" is satisfied, can be set to approximately 10% of the output value S4 before the nip of the front edge of the paper P fed by the feed roller 14 by the pair of transport rollers 16.

Configuration in Vicinity of Receiving Portion

Hereinafter, the configuration in the vicinity of the receiving portion 32 will be described with reference to FIGS. 3 and 6 to 9.

As described above, the transmitting portion 31 and the receiving portion 32, which constitute the medium detection section 30, are respectively disposed in the upper concave portion 23, provided on the upper path face 21 side, and in the lower concave portion 24, provided on the lower path face 22 side (FIG. 3).

Here, the paper P being transported on the paper transport path T (FIG. 3) is transported in such a way as to be slightly pressed to the lower path face 22 side by the feed roller 14 and the separation roller 15. For this reason, there is a possibility that the front edge of the paper P may be caught by an edge (particularly, a downstream side edge) of an opening 25 (FIG. 6) of the lower concave portion 24, provided on the lower path face side 22. In order to reduce this possibility, a medium scooping portion 26, illustrated in FIGS. 6 to 9, is provided in the lower concave portion 24, in which the receiving portion 32 is disposed. The medium scooping portion 26 is provided in such a way as to protrude toward the inside from the opening 25, and partially cover a downstream side portion of the receiving portion 32.

The medium scooping portion 26 allows its shape for scooping the paper P to be formed into a slope on which the front edge of the paper P ascends from the upstream side toward the downstream side. The above configuration, in which such the scooping portion 26 is provided in the opening 25 of the lower concave portion 24, enables the reduction of the possibility that the paper P being transported may be caught by the edge (particularly, the downstream side edge) of the opening 25 of the lower concave portion 24. In this case, although the medium scooping portion 26 is provided in such a way as to partially cover the downstream side portion of the receiving portion 32, this downstream side portion of the receiving portion 32 is a region where the sensitivity as the receiving portion 32 is decreased, thus enabling the medium scooping portion 26 to be formed in such a way that the influence on the receiving status of the receiving portion 32 is reduced.

Practice Example 2

Figure 10:
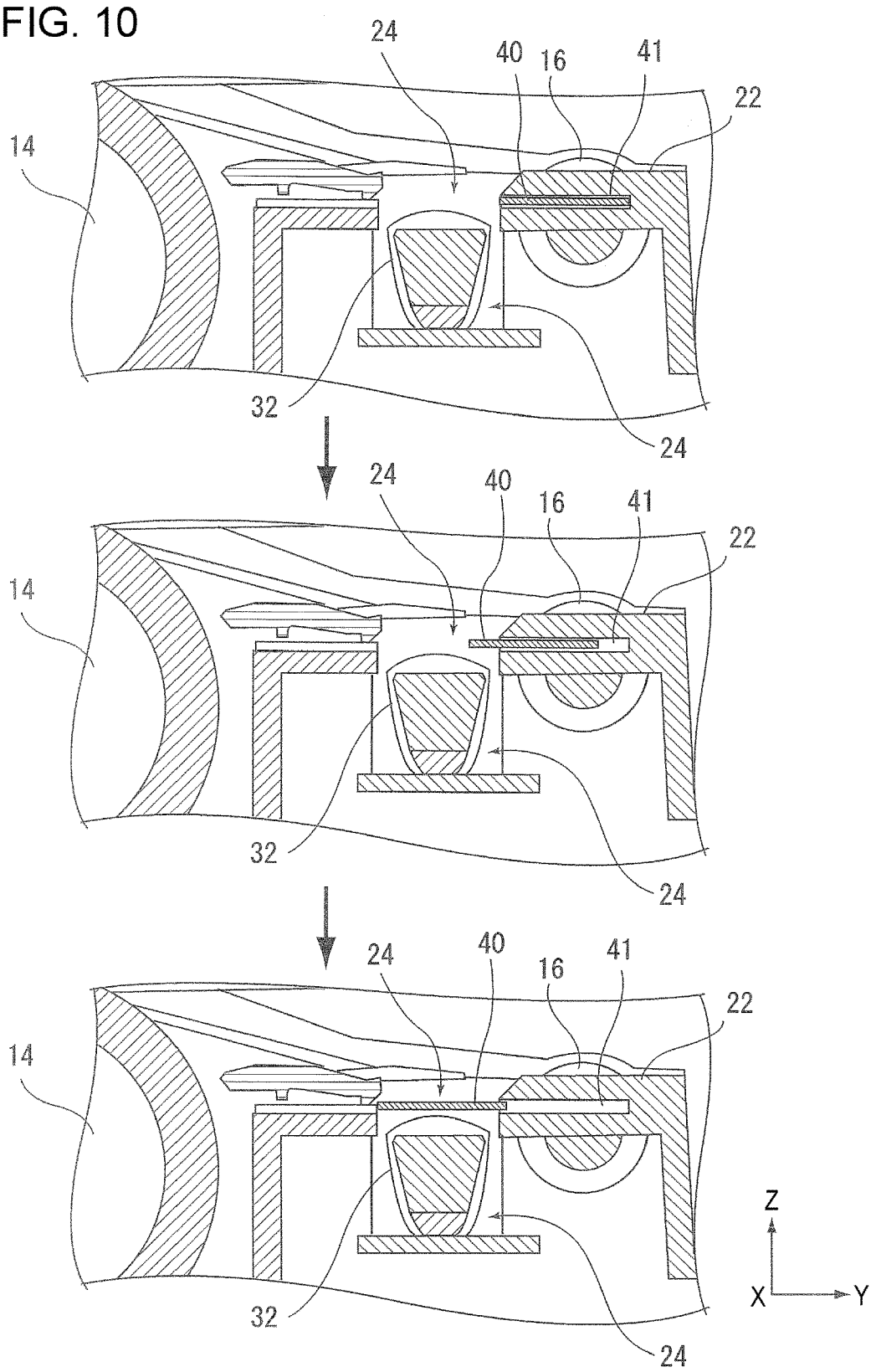
FIG. 10 is a cross-sectional view of the vicinity of a receiving portion according to practice example 2, taken along the Y-Z plane.

In this practice example 2, the configuration in the vicinity of the receiving portion 32 will be described with reference to FIG. 10. FIG. 10 is a cross-sectional view of the vicinity of the receiving portion 32 according to practice example 2, taken along the Y-Z plane. Note that, in the present practice example, the same components as the components of practice example 1 will be denoted by the same reference signs as those of the components of practice example 1, and thereby will be omitted from description.

In the present practice example, a shutter portion 40 (FIG. 10) is provided in the opening 25 of the lower concave portion 24 in which the receiving portion 32 is disposed. The shutter portion 40 is capable of adjusting an open state of the opening 25 of the lower concave portion 24 in such a way as to slide from the downstream side toward the upstream side in the medium transport direction. The shutter portion 40 is configured to be capable of sliding by means of power supplied from an unillustrated driving source. The operation of the shutter portion 40 is controlled by the control section 19.

In the present practice embodiment, the shutter portion 40 is allowed to slide from an open state in which, as illustrated in a figure at the upper stage of FIG. 10, the shutter portion 40 is contained in a containing portion 41 and the opening 25 is allowed to entirely open, to a closed state in which, as illustrated in a figure at the lower stage of FIG. 10, the shutter portion 40 is allowed to protrude from the containing portion 41 and the opening 25 is entirely closed. The opening/closing of the shutter portion 40 enables the adjustment of the open state of the opening 25 of the lower concave portion 24.

The open state of the opening 25 of the lower concave portion 24 is preferred to be changed in accordance to the kind of the paper P being transported. For example, when the paper P being transported is thin paper, as illustrated in a figure at the middle stage of FIG. 10, the shutter portion 40 is allowed to slide in such a way as to bring the opening 25 into an open state in which the shutter portion 40 partially covers the downstream side portion of the receiving portion 32.

In the case where paper P being transported is the thin paper, the paper P, which is the thin paper, is likely to be caught by the edge of the downstream side portion of the opening 25 of the lower concave portion 24. Thus, when the paper P being transported is the thin paper, the above configuration, which brings the opening 25 into the open state (illustrated in the figure at the middle stage of FIG. 10) in which the shutter portion 40 partially covers the downstream side portion of the receiving portion 32, enables the reduction of the possibility that the thin paper may be caught by the side edge of the downstream side portion of the opening 25. In this case, although the shutter portion 40 is provided in such a way as to partially cover the downstream side portion of the receiving portion 32, the downstream side portion of the receiving portion 32 is a region where the sensitivity as the receiving portion 32 is decreased, thus enabling the influence on the receiving status of the receiving portion 32 to be reduced.

Further, in the case where the medium detection using the medium detection section 30 is not made, the shutter portion 40 is preferred to be brought into the closed state (illustrated in the figure at the lower stage of FIG. 10), in which the shutter portion 40 entirely covers the opening 25. In the case where the medium detection using the medium detection section 30 is not made, the opening 25 for exposing the unnecessary receiving portion 32 is covered by the shutter portion 40, thereby enabling the reduction of the possibility that the paper P being transported may be caught by the side edge of the opening 25 of the lower concave portion 24, in which the receiving portion 32 is provided. In this case, a configuration including both of the shutter portion 40 and the medium scooping portion 26, which has been described in practice example 1, is also applicable.

In addition to the aforementioned description, the invention is not limited to the above practice examples, and various modifications are applicable within the scope of the invention as set forth in appended claims. Obviously, such modifications are included in the scope of the invention.

The entire disclosure of Japanese Patent Application No. 2017-127042, filed Jun. 29, 2017 is expressly incorporated by reference herein.

What is claimed is:

1. An image reading apparatus comprising:

a reading section configured to read a medium being transported;

feeding means configured to feed the medium toward the reading section; and a medium detection section provided along a medium transport path between the feeding means and the reading section and configured to include a transmitting portion configured to emit an ultrasonic wave and a receiving portion configured to receive the ultrasonic wave emitted from the transmitting portion, and output an output value equivalent to a magnitude of the received ultrasonic wave, wherein, in a case where the output value of the receiving portion satisfies a first condition, a transport of the medium is continued, wherein, in a case where the output value of the receiving portion satisfies either a second condition different from the first condition or a third condition different from the second condition, the transport of the medium is brought to a halt, wherein a lower limit value and an upper limit value are set in accordance with a kind of the medium, wherein the first condition is satisfied in a case where the output value falls within a reference range prescribed by the lower limit value and the upper limit value, wherein the second condition is satisfied in a case where the output value is lower than the lower limit value, wherein the third condition is satisfied in a case where the output value is higher than the upper limit value, wherein the receiving portion is disposed in a concave portion provided on a side of one transport path face among a pair of transport path faces between which the medium being transported is interposed, and wherein the concave portion includes a shutter portion configured to slide from a downstream side toward an upstream side to adjust an open state of an opening of the concave portion.

2. The image reading apparatus according to claim 1, wherein, in a case where the output value of the receiving portion satisfies the second condition, a notification that the media being transported is in a multi-fed state is provided, and wherein, in a case where the output value of the receiving portion satisfies the third condition, a notification that the medium being transported is a single sheet of medium including one or more fold shapes or one or more wrinkle shapes is provided.

3. The image reading apparatus according to claim 1, further comprising a pair of transport rollers provided on a downstream side of the feeding means and an upstream side of the reading section, wherein the third condition includes a condition in which a difference between the output value of the receiving portion for a first interval and the output value of the receiving portion for a second interval exceeds a predetermined range, the first interval being an interval up to an arrival at a nip point of the pair of transport rollers by a front edge of the medium fed by the feeding means after passing through the medium detection section by the front edge of the medium, the second interval being an interval subsequent to passing through the nip point of the pair of transport rollers by the front edge of the medium.

4. The image reading apparatus according to claim 1, wherein the third condition includes a condition in which a difference between the output value of the receiving portion for an antecedent medium and the output value of the receiving portion for a subsequent medium exceeds a predetermined range.

5. The image reading apparatus according to claim 1 wherein, when the medium is thin paper, the opening is brought into an open state in which a portion of the shutter portion partially covers a downstream side portion of the receiving portion.

6. The image reading apparatus according to claim 1, wherein, in a case where a medium detection using the medium detection section is not made, the opening is brought into a closed state in which the shutter portion entirely coves the opening.

7. An image reading apparatus comprising:

a reading section configured to read a medium being transported;

feeding means configured to feed the medium toward the reading section; and a medium detection section provided along a medium transport path between the feeding means and the reading section and configured to include a transmitting portion configured to emit an ultrasonic wave and a receiving portion configured to receive the ultrasonic wave emitted from the transmitting portion, and output an output value equivalent to a magnitude of the received ultrasonic wave, wherein, in a case where the output value of the receiving portion satisfies a first condition, a transport of the medium is continued, wherein, in a case where the output value of the receiving portion satisfies either a second condition different from the first condition or a third condition different from the second condition, the transport of the medium is brought to a halt, wherein a lower limit value and an upper limit value are set in accordance with a kind of the medium, wherein the first condition is satisfied in a case where the output value falls within a reference range prescribed by the lower limit value and the upper limit value, wherein the second condition is satisfied in a case where the output value is lower than the lower limit value, wherein the third condition is satisfied in a case where the output value is higher than the upper limit value, wherein the receiving portion is disposed in a concave portion provided on a side of one transport path face among a pair of transport path faces between which the medium being transported is interposed, and wherein the concave portion includes a medium scooping portion provided in such a way as to protrude from an opening of the concave portion toward an inside, and partially cover a downstream side portion of the receiving portion.

* * * * *